US006276862B1

(12) United States Patent
Snyder et al.

(10) Patent No.: US 6,276,862 B1
(45) Date of Patent: Aug. 21, 2001

(54) BINDER MECHANISM

(75) Inventors: Michael Thom Snyder, Chicago; Timothy Edward McKeown, Glen Ellyn; R. Hal Monson; David Little, both of Evanston, all of IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/396,403

(22) Filed: Sep. 15, 1999

(51) Int. Cl.[7] ..... B42F 13/00; B42F 3/04; B42F 13/12

(52) U.S. Cl. ..... 402/40; 402/5; 402/26; 402/41; 402/52

(58) Field of Search ..... 402/5, 26, 40, 402/41, 52

(56) References Cited

U.S. PATENT DOCUMENTS

| | | | |
|---|---|---|---|
| Re. 23,967 | 3/1955 | Minkoff | 129/24 |
| 566,717 | 8/1896 | Krah . | |
| 651,254 | 6/1900 | Krah . | |
| 700,867 | 5/1902 | Whitlock . | |
| 720,548 | 2/1903 | Whitlock . | |
| 724,599 | 4/1903 | McMillan . | |
| 724,849 | 4/1903 | Gresham . | |
| 736,343 | 8/1903 | Akass . | |
| 760,848 | 5/1904 | Carney et al. . | |
| 778,992 | 1/1905 | Nelson . | |
| 793,370 | 6/1905 | Gresham . | |
| 794,290 | 7/1905 | Ford . | |
| 794,536 | 7/1905 | McMillan . | |
| 798,301 | 8/1905 | Schade, Jr. . | |
| 818,548 | 4/1906 | McNeal . | |
| 819,368 | 5/1906 | Nelson . | |
| 830,579 | 9/1906 | Eddy . | |
| 854,074 | 5/1907 | Bryant . | |
| 857,253 | 6/1907 | McMillan . | |
| 857,377 | 6/1907 | Baker . | |
| 867,815 | 10/1907 | Garland . | |
| 868,683 | 10/1907 | Morden . | |
| 898,385 | 9/1908 | McNeal . | |
| 924,647 | 6/1909 | Eddy . | |
| 938,530 | 11/1909 | Webster . | |
| 959,183 | 5/1910 | Trussell et al. . | |

(List continued on next page.)

FOREIGN PATENT DOCUMENTS

| | | |
|---|---|---|
| 536432 | 6/1921 | (FR) . |
| 656338 | 11/1927 | (FR) . |
| 9117 | 4/1914 | (GB) . |
| 190860 | 1/1923 | (GB) . |

*Primary Examiner*—A. L. Wellington
*Assistant Examiner*—Mark T. Henderson
(74) *Attorney, Agent, or Firm*—Pennie & Edmonds LLP

(57) ABSTRACT

A binder mechanism comprises a pair of prong plates pivotally connected by a retainer spring to toggle between a first raised position and a second lowered position. The prong plates include a plurality of ring segments affixed to the prong plates that are capable of forming loops. A cam mechanism is used to toggle the prong plates between the raised and lowered positions causing the ring segments to open or to close to form loops. The cam mechanism is preferably a slider located above the prong plates, the slider having ramps inserted through recesses between the prong plates. Preferably, the recesses are located adjacent to where the ring segments are attached to the prong plates. Cleats may hold the parts of the binder mechanism together and keep the mechanism attached to a binder assembly. Preferably, the retainer spring is in the form of a top spring covering both the slider and prong plates. A handle may be attached to both the top spring and slider such that when the handle is pivoted it moves the slider longitudinally away from the handle causing the ramps to contact the prong plates adjacent the recesses resulting in the prong plates moving upward or downward to open or close the ring segments to form loops.

28 Claims, 5 Drawing Sheets

U.S. PATENT DOCUMENTS

| | | | | |
|---|---|---|---|---|
| 986,910 | | 3/1911 | Dawson et al. . | |
| 1,042,625 | | 10/1912 | Watson . | |
| 1,097,391 | | 5/1914 | Couch . | |
| 1,201,214 | | 10/1916 | Miller . | |
| 1,212,565 | | 1/1917 | Schade, Jr. . | |
| 1,215,371 | | 2/1917 | Hawkins . | |
| 1,231,816 | | 7/1917 | Vesterling . | |
| 1,342,833 | | 6/1920 | Sutherland . | |
| 1,439,367 | * | 12/1922 | Krag | 402/41 |
| 1,440,394 | | 1/1923 | Krag . | |
| 1,441,140 | | 1/1923 | Wirt . | |
| 1,537,894 | | 5/1925 | Smith . | |
| 1,758,327 | | 5/1930 | Lotter . | |
| 1,857,291 | | 5/1932 | Trussell . | |
| 2,000,184 | | 5/1935 | Lotter | 129/9 |
| 2,013,416 | | 9/1935 | McClure | 129/24 |
| 2,020,129 | | 11/1935 | Wedge | 129/24 |
| 2,024,461 | | 12/1935 | Lotter | 129/9 |
| 2,061,676 | | 11/1936 | Schade | 129/24 |
| 2,103,307 | | 12/1937 | Unger | 129/24 |
| 2,104,046 | | 1/1938 | Krag | 129/9 |
| 2,105,235 | | 1/1938 | Schade | 129/24 |
| 2,178,767 | | 11/1939 | Unger et al. | 129/24 |
| 2,179,627 | | 11/1939 | Handler . | |
| 2,282,976 | | 5/1942 | Martin | 129/17 |
| 2,365,643 | | 12/1944 | Martin | 129/17 |
| 2,461,050 | | 2/1949 | Gibson | 129/11 |
| 3,077,888 | | 2/1963 | Thieme | 129/24 |
| 3,205,895 | | 9/1965 | Johnson | 129/24 |
| 3,833,308 | | 9/1974 | Seaborn | 402/56 |
| 3,954,343 | | 5/1976 | Thomsen | 402/41 |
| 4,130,368 | | 12/1978 | Jacoby et al. | 402/41 |
| 4,172,675 | | 10/1979 | Lacourt | 402/27 |
| 4,486,112 | | 12/1984 | Cummins | 402/34 |
| 4,566,817 | | 1/1986 | Barrett, Jr. | 402/38 |
| 4,571,108 | | 2/1986 | Vogl | 402/38 |
| 4,733,985 | | 3/1988 | Moosmüller, deceased | 402/27 |
| 4,919,557 | | 4/1990 | Podosek | 402/41 |
| 5,100,253 | | 3/1992 | Cooper | 402/75 |
| 5,160,209 | | 11/1992 | Schuessler | 402/75 |

* cited by examiner

BINDER MECHANISM

FIELD OF THE INVENTION

This invention relates generally to binders, and more particularly to loose-leaf binder mechanisms, which include a slider.

BACKGROUND OF THE INVENTION

Loose-leaf binders include binder mechanisms for holding loose sheets of paper. Conventional loose-leaf binder mechanisms include ring segments that abut to form rings. The ring segments are separated to facilitate the insertion of paper to the binder or the removal of paper from the binder. Often, the ring mechanisms include actuators to separate the ring segments between the opened and closed positions. These can include actuating bars. Locking mechanisms protect against accidental opening of the rings, and possible damage to the papers stored in the binder that may occur should it accidently open. Typically, binder mechanisms require two-hands to operate.

Various forms of binder mechanisms have incorporated actuating bar mechanisms. U.S. Pat. No. 2,013,416 to McClure, teaches a snap-ring loose-leaf binder mechanism with a spring back plate with channels formed in its edges to receive a pair of prong plates, and semicircular rings secured to the prong plates that form rings in their closed position. An actuating bar includes cam members that receive tongue portions of the prong plates adapted to ride in cam slots of the cam members. When the actuating bar is slid, the tongue portions of the prong plates move in cam slots to move the prong plates and thereby cause the rings to open or close. The tongue portions are located distantly from the rings. The assembly includes a back plate on which the cam members slide. The actuating bar is exposed outside of the assembly and is pulled linearly beyond the edge of the binder.

Two similar references are U.S. Pat. No. 4,571,108 to Vogl and U.S. Pat. No. 4,566,817 to Barrett, Jr. Vogl, for instance, teaches a locking ring binder mechanism with a cover, a base, two hingedly connected plates located between the cover and the base. Rings are attached to the hingedly connected plates. A control slide is compressed between the cover and the base such that there is friction between their surfaces to prevent unintentional movement of the control slide. The control slide features a number of slants or incline surfaces and cam surfaces. These pass through openings in the plates. When the control slide is moved, the portions of the slide passing through the openings in the plates connect with the edges of the plates and force the plates up or down to move the rings to an open or closed position. The cam surfaces are located distally from the rings. The mechanism includes a base upon which the control slide moves and the control slide is compressed between the base and the cover to create friction between their surfaces.

Further, French Patent No. 656,338, discloses a handle that pivots to move a slider using an additional pivot arm. The construction disclosed uses an additional pivot arm.

Also, U.S. Pat. Nos. 5,035,526 and 5,100,253 to Cooper et al. and Cooper respectively, disclose cleats that are used to secure the binder mechanism to a binder assembly. A plurality of plates having prongs or nail bursts are used for securing the plates to a backing or spine of a binder. An upstanding deformable rivet is mounted on each plate. The rivets secure the binder or ring mechanism with a support member to the backing of the binder assembly. Support member are used to attach the binder mechanism to the backing or spine of the binder.

SUMMARY OF THE INVENTION

A binder mechanism comprises a pair of prong plates pivotally connected by a retainer spring to toggle between a first raised position and a second lowered position. The prong plates include a plurality of ring segments affixed to the prong plates that are capable of forming loops. A cam mechanism is used to toggle the prong plates between the raised and lowered positions causing the ring segments to open or to close to form loops. The cam mechanism is preferably a slider located above the prong plates, the slider having ramps inserted through recesses between the prong plates. Preferably, the recesses are located adjacent to where the ring segments are attached to the prong plates. Cleats may hold the parts of the binder mechanism together and keep the binder mechanism attached to a binder assembly.

Another embodiment of a binder mechanism according to the present invention features a top spring and two prong plates that are held against each other by sides of the top spring and toggle toward and away from the top spring, opening and closing binder ring segments that are attached to the prong plates. Preferably, cleats of the binder have a flat base that is attached to the binder and rivets that hold the binder mechanism together. Preferably, a slider includes ramps extending through recesses between the prong plates and supported against the bases of the cleats, reducing wear to the folder caused by friction with the slider. A handle is pivotably attached to the top spring and the slider. The handle slides the slider longitudinally, causing the ramps to move the prong plates to open or close the ring segmnents. The ramps move the prong plates adjacent to the rings to minimize warping of the prong plates.

In another embodiment, the recesses of the prong plates include recess edges. The prong plates are held in place by the top spring and are wedged by the ramps on the slider. The handle is pivotally attached to the top spring and slider. When the handle is pivoted, the slider moves longitudinally away from the handle. As the slider moves, the ramps slide upon the bases of the cleats, thereby reducing damage to the surface of the binder. As the slider moves, the ramps contact the recess edges and cause the prong plates to raise up or down. This movement of the prong plates causes the rings to open and close. Because the slider wedges the prong plates adjacent to where the ring segments are attached to the prong plates, improved locking is created because the prong plates cannot move unless the slider moves.

The shape of the prong plates and the slider mechanism control the motion of the rings throughout the cycle. Further, preferably the manipulation of the ring segments to an open or closed position is performed by use of only one handle. In one embodiment of the binder mechanism according to the present invention, the user is able open and close the binder with one handle, leaving the other hand free to assist in adding or removing paper.

Another embodiment of the present invention reduces the probability of paper getting loose when the binder is dropped. The improved locking may be accomplished by the addition of a slider with ramps and cams that will prevent the prong plates from moving even if the binder is dropped.

DESCRIPTION OF THE PREFERRED EMBODIMENT

Figure 1:
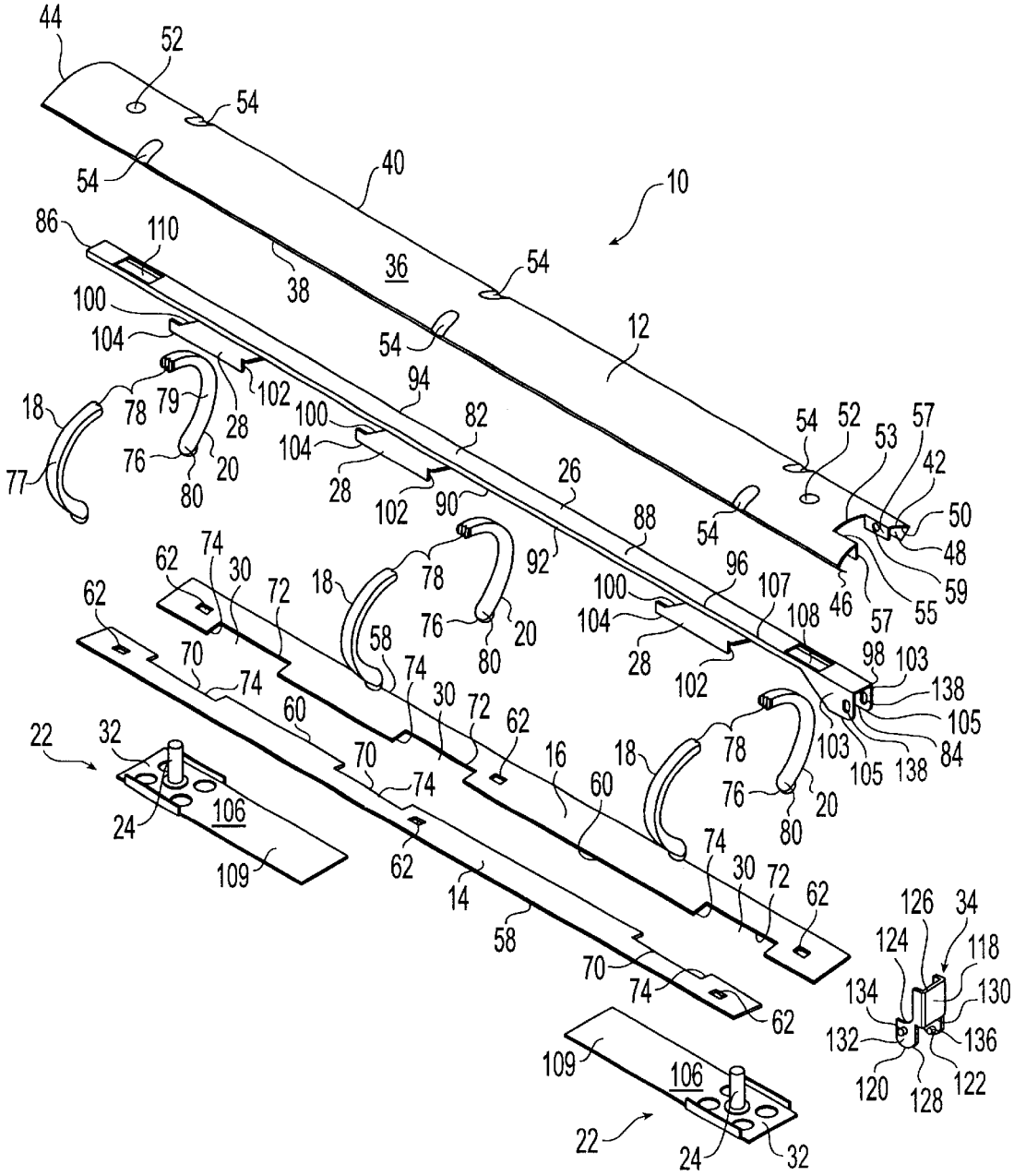
FIG. 1 is an exploded view of a binder mechanism according to the present invention.
Figure 2:
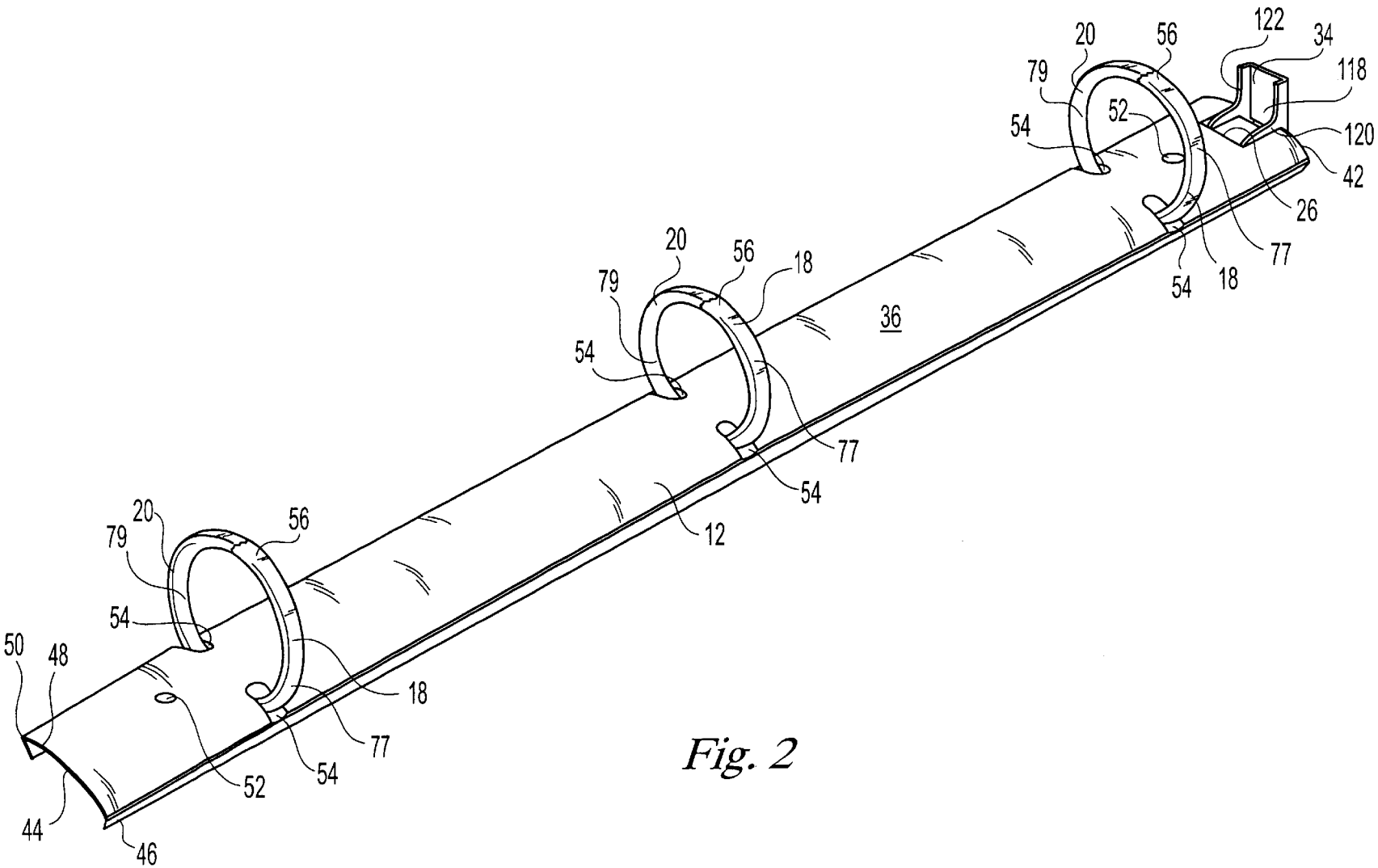
FIG. 2 is a perspective view of a binder mechanism according to the present invention, wherein the ring segments are in a closed position.
Figure 3:
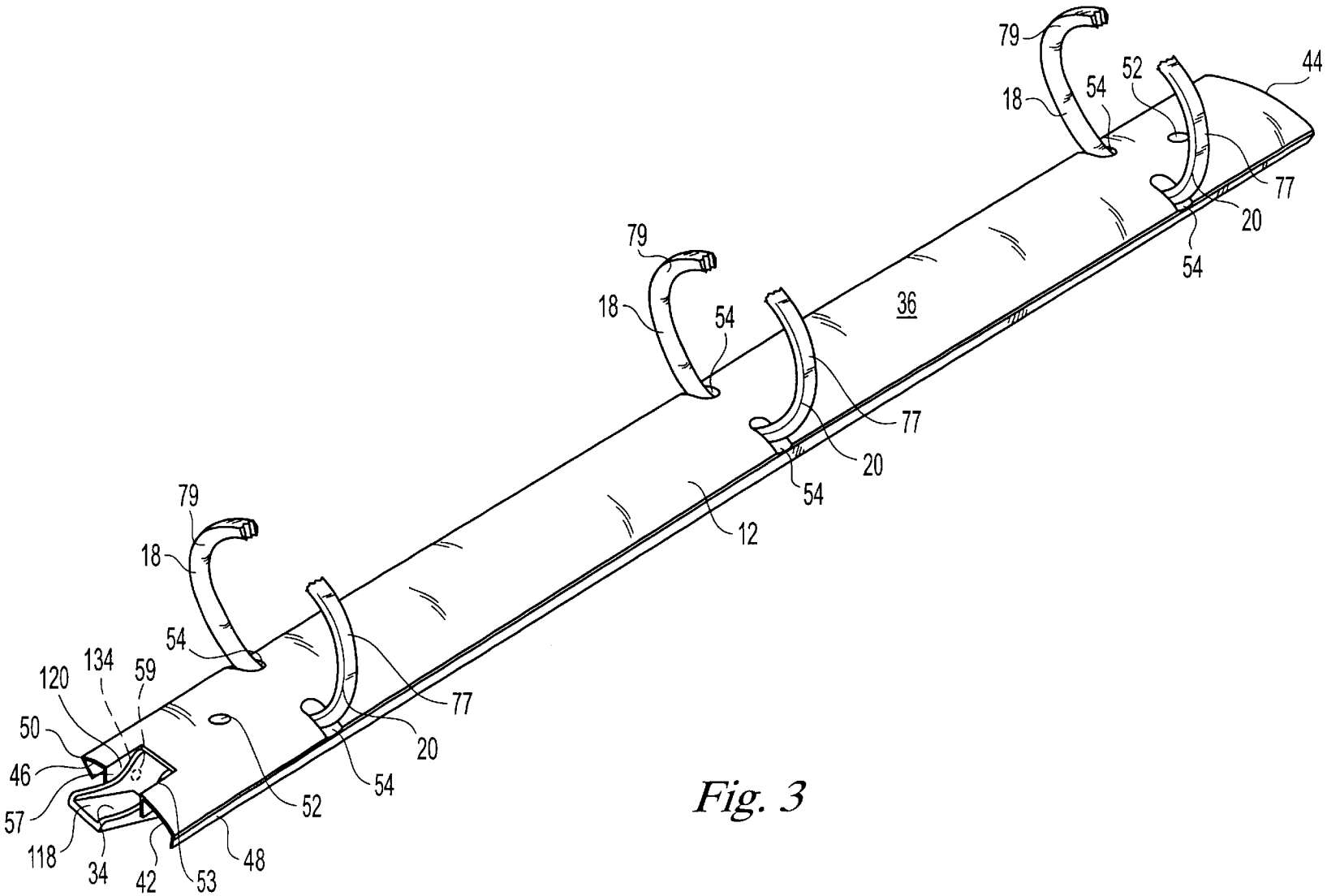
FIG. 3 is a perspective view of a binder mechanism according to the present invention, wherein the ring segments are in an open position.

Referring to FIGS. 1–3, a binder mechanism 10 according to an embodiment of the present invention is shown. FIG. 1 shows an exploded view of the parts that comprise the binder mechanism 10. The binder mechanism 10 preferably has a retainer spring 12, two prong plates 14 and 16 are held in over center side-by-side relation by the retainer spring 12. Preferably, as shown, the retainer spring 12 is a top spring 12 with the prong plates 14 and 16 held side-by-side under the top spring 12. The over center position allows the prong plates to toggle up and down for opening and closing binder ring segments 18 and 20 that are attached to the prong plates 14 and 16. An attachment mechanism 22 is used to hold the binder mechanism 10 together and attach it to a binder assembly. Preferably, the attachment mechanism 22 are cleats 22 having posts or rivets 24 that hold the binder mechanism 10 together and attach the binder mechanism 10 to a binder assembly (shown in FIGS. 5 and 6). However, posts, rivets, pins, glue or any other attachment mechanism known to those skilled in the art for attaching binder mechanisms could be used. The binder assembly can be a binder, spine, cover or any other device in which it is desirable to hold sheets of paper.

A cam mechanism 26 is located in the binder mechanism 10 to toggle the prong plates 14 and 16 between a first raised position and a second lowered position for opening and closing the binder ring segments 18 and 20. The cam mechanism may have cam members. The cam mechanism 26 could be actuatable by moving the device longitudinally, rotatably, laterally or any other actuation known to those skilled in the art to toggle the prong plates 14 and 16. As shown in FIG. 1, the cam mechanism 26 is preferably a slider 26 located in the binder mechanism 10 and including ramps 28 that extend through recesses 30 between the prong plates 14 and 16. Preferably, at least one ramp 28 is supported against base 32 of one cleat 22. Also, preferably a handle 34 is pivotably attached to the top spring 12 and slider 26 and is capable of moving the slider 26 to toggle the prong plates 14 and 16 for opening or closing the ring segments 18 and 20.

In one embodiment of the present invention as shown in FIG. 1, the top spring 12 includes a top arcuate surface 36 having a first edge 38 parallel to a second edge 40 and two ends 42 and 44. A first flange 46 is attached to the first edge 38 and a second flange 48 is attached to the second edge 40. The first and second flanges 46 and 48 extend substantially along the length of the ends 42 and 44 of the top arcuate surface 36. Each flange 46 and 48 extends inwardly and is angled away from the top arcuate surface 36 and includes an inside edge 50 where the flange 46 and 48 and the top surface 36 converge. The top surface 36 further includes an opening 52 for receiving the rivets 24 of the cleats 22 for completing assembly of the binder mechanism 10. As shown, preferably there are two openings 52 for receiving the respective rivets 24 located towards each of the ends 42 and 44 of the top arcuate surface 36.

Figure 6:
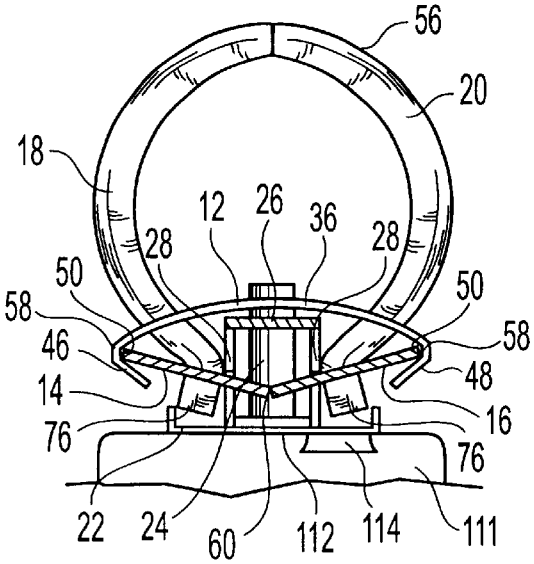
FIG. 6 is a partial, cross-sectional view of the binder mechanism along arrow 3, 4 of FIG. 2, wherein the prong plates are in a lowered position.

The top surface 36 also includes several slots 54 that extend through the flanges 46 and 48 and are aligned with the ring segments 18 and 20 on the prong plates 14 and 16 such that the ring segments 18 and 20 will be placed through the slots 54. Further, the slots 54 are extended to accommodate the opening and closing movement of the ring segments 18 and 20. As shown, there are three pairs of slots 54. Preferably two pairs of slots 54 are located towards the ends 42 and 44 of the top spring 12 and one pair of slots 54 is located intermediate those ends 42 and 44 to accommodate the ring segments 18 and 20. Preferably, the intermediate pair of slots 54 is located in the center of the top spring 12. Preferably, the pairs of slots 54 located towards the ends 42 and 44 of the top spring 12 are located at about less than one-half of the distance from the ends 42 and 44 to the center of the top spring 12. Each pair of slots 54 is preferably in perpendicular alignment with the length of the binder mechanism 10. Each slot 54 receives a ring segment 18 and 20 such that two opposing ring segments 18 and 20 mate to form a loop or ring 56 in a closed position (as shown in FIGS. 2 and 6). As shown, the ring segments 18 and 20 form a circular ring; however, any shape ring may be formed such as a D-shaped ring or any other shaped ring known to those skilled in the art.

The top spring 12 provides a notch 53 having notch edges 55 to accommodate the handle 34. Preferably, the notch 53 is rectangular and centered on the top surface 36 at the first end 42 of the top spring 12. Preferably, the rectangular notch 53 features two tabs 57 extending downwardly from two notch edges 55, the tabs 57 each having a pivot point 59. Most preferably, the tabs 57 are in parallel relation with each other with the pivot points 59 being aligned.

Figure 5:
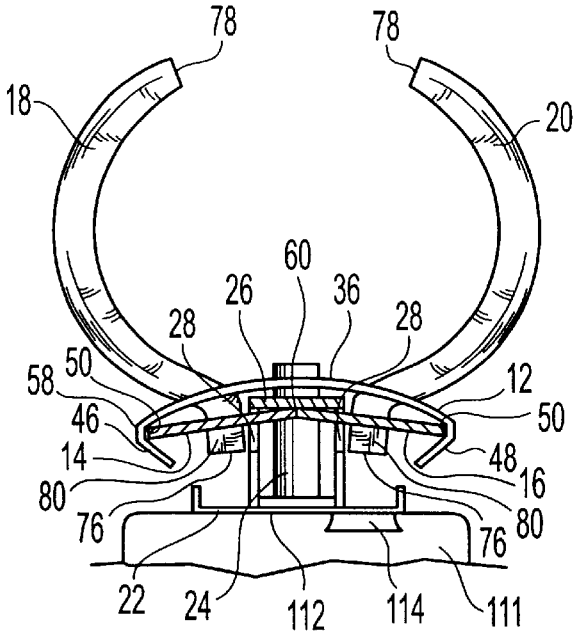
FIG. 5 is a partial, cross-sectional view of the binder mechanism along arrow 3, 4 of FIG. 2, wherein the prong plates are in a raised position.

As shown in FIG. 1, 5 and 6, the prong plates 14 and 16 are elongated plates placed in a side-by-side relation. Each prong plate 14 and 16 has an outer edge 58 and an inner edge 60. The outer edges 58 are received by the first and second flanges 44 and 46 of the top spring 12 and rest against the inside edge 50 of the flanges 44 and 46 and the top spring 12. Because of their placement, the inner edges 60 of the plates 14 and 16 are held securely against each other. The relationship between the inner edges 60 of the prong plates 14 and 16 and their over center relationship allows the prong plates 14 and 16 to toggle toward the top spring 12 to a first raised position, as shown in FIG. 5, and away from the top spring 12 to a second lowered position, as shown in FIG. 6.

The prong plates 14 and 16 also include several attachment positions, preferably apertures 62, for receiving the ring segments 18 and 20. As shown in FIG. 1, there are three pairs of apertures 62, each pair being aligned in a perpendicular relationship to the length of the binder mechanism 10. Further, the apertures 62 are aligned so that the ring segments 18 and 20 are directly across from each other to form the ring 56 when the prong plates 14 and 16 are toggled to their second lowered position, as shown in FIG. 6. The apertures 62 are also aligned with the slots 54 in the top spring 12 such that the ring segments 18 and 20 will fit through the slots 54.

As shown in FIG. 1, preferably the prong plates 14 and 16 are shorter than the top spring 12 and the slider 26. Thus, it is not necessary for the prong plates 14 and 16 to be capable of accommodating the rivets 24 of the cleats 22 for completing assembly of the binder mechanism 10. The prong plates 14 and 16 are short enough to fit in between the rivets 24. Because of the prong plates 14 and 16 length, the rivets 24 are received by the slider 26 and the top spring 12. However, if the prong plates 14 and 16 are longer, the inner edge 60 of each prong plate 14 and 16 can feature complementary pairs of matching notches. Each notch on one prong plate would mate with the complementary opposing notch on the other prong plate to form a bole for receiving the rivet of the cleat to complete the assembly of the binder mechanism 10.

Figure 4:
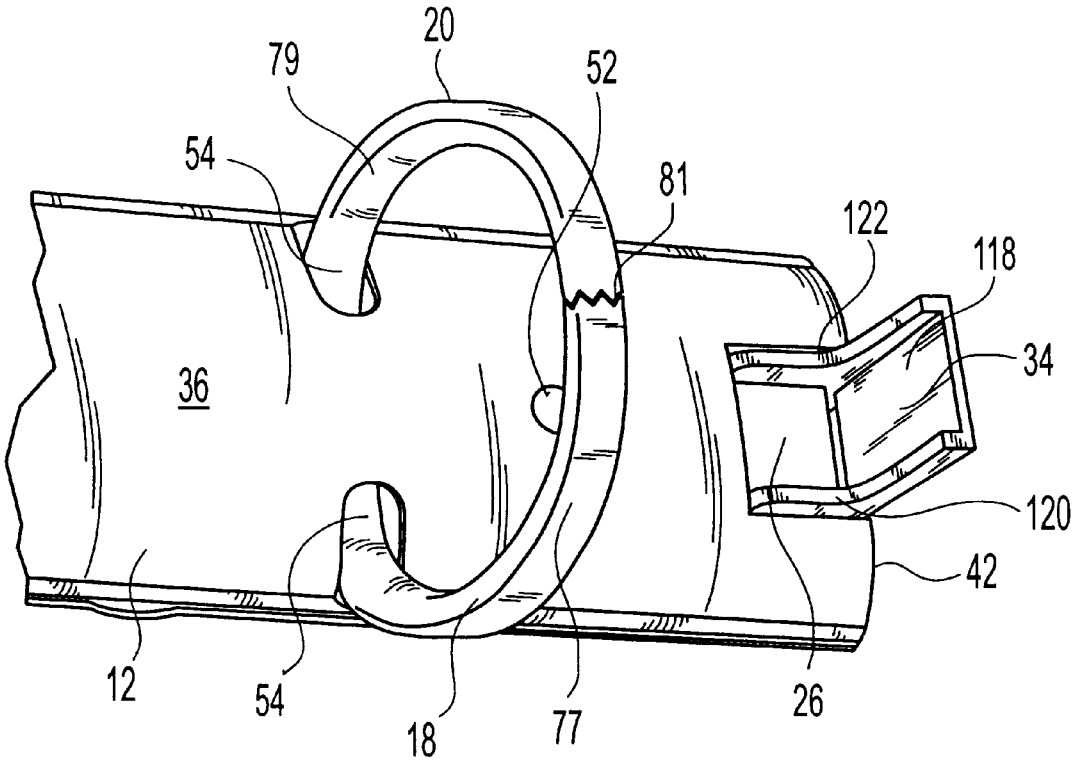
FIG. 4 is a partial view of the handle of the binder mechanism according to the present invention, wherein the ring segments are in a closed position.

Finally, as shown in the embodiment of FIG. 1, the inner edges 60 of the prong plates 14 and 16 feature complementary cutouts 70 and 72. The cutouts 70 and 72 may be formed through cutting, stamping, casting, molding or any other method known to those skilled in the art to form the recess 30. Each cutout 70 mates with an opposing cutout 72 on the opposite prong plate to form the recess 30 having recess edges 74. The cutouts 70 and 72 could be made in a variety of shapes and numbers to accommodate the shape and number of pairs of ramps 28. As shown, preferably, there are three recesses 30 formed immediately adjacent to the apertures 62 that receive the ring segments 18 and 20. Locating the recesses 30 near the apertures 62 that receive the ring segments 18 and 20 allows actuation of the prong plates 14 and 16 near the ring segments 18 and 20 which assists in preventing warping of the prong plates 14 and 16. Each recess 30 has a length. Preferably, each recess 30 is located no more than twice its length 30 from the closest pair of apertures 62. More preferably, each recess 30 is located no more its length from the closest pair of apertures 62. Most preferably, each recess 30 is located no more than one-half its length from the closest pair of apertures 62. Preferably, two of the recesses 30 are located toward opposing ends of the prong plates 14 and 16 and the third is between the two ends. Preferably, the third recess 30 is off-set from the center of the prong plates. Most preferably, the third recess 30 is off-set from the center and away from the end of the binder mechanism 10 with the handle 34. Referring to FIGS. 1, 5 and 6, the ring segments 18 and 20 are preferably formed as arcs having two ends 76 and 78. The first end 76 has a straight end piece 80. This end piece 80 fits within the aperture 62 formed in the prong plates 14 and 16 to affix the ring segments 18 and 20 to the prong plates 14 and 16. As shown in FIGS. 1–4, the ring segments 18 and 20 feature a flat outer surface 77 with a rounded inner surface 79. The flat outer surface 77 reduces the amount of materials used which makes the binder mechanism lighter and less expensive. The rounded inner surface 79 maintains a smooth circular surface for holding the papers. Further, as shown in FIG. 1, the second ends 78 of the ring segments may be flat where they interface with each other. Moreover, second ends 78 of the ring segments 18 and 20 may also have interlocking portions or ridges 81 as shown in FIG. 4.

The ring segments 18 and 20 are formed such that when the prong plates 14 and 16 are toggled to their first raised position the second end 78 of each ring segment 18 on one prong plate 14 mates with the second end 78 of the opposing ring segment 20 on the second prong plate 16 to form the ring 56. The ring 56 retains papers within the binder mechanism 10. When the prong plates 14 and 16 are toggled into their second lowered position, the ring segments 18 are separated so that papers may be inserted or removed from the binder mechanism 10.

As shown in FIG. 1, the slider 26 with a beam 82 includes two ends 84 and 86 between two elongated surfaces 88 and 90 having two edges 92 and 94. The first elongated surface 88 is flat. The second surface 90 includes two flanges 96 and 98 perpendicular to the second surface 90 and extending substantially along the length of the two edges 92 and 94. Further, ramps 28 extend from the flanges 96 and 98. Preferably, the ramps 28 are in parallel alignment with each other and are in perpendicular alignment to the surfaces 88 and 90 of the beam 82. The ramps 28 feature a slight incline 100 and a stop 102. The ramps 28 also feature a flat bottom edge 104. Preferably, the incline 100 is at an angle from the bottom edge of about 10 to 50 degrees, and more preferably about 20 to 30 degrees. Preferably, the flat bottom edge 104 is in parallel alignment with the two elongated surfaces 88 and 90.

As shown, preferably there are three pairs of ramps 28, one half of each pair being on an opposing edge 92 and 94 of the beam 82. Two pairs of ramps 28 are located toward opposing ends 84 and 86 of the beam 82 and the third is in between the two ends 84 and 86. As shown, preferably the third ramp 28 is off-set from the center of the slider 26. More preferably, the third ramp 28 is off-set from the center and closer to the second end 86 of the slider 26 such that the ramp 28 fits within the third recess 30. Preferably, the two pairs of ramps 28 located towards the ends 84 and 86 of the slider 26 are located at about less than two-thirds of the distance from the ends 84 and 86 to the center of the slider 26. More preferably, the ramps 28 are located at about less than one-third of the distance from the ends 84 and 86 to the center of the slider 26.

The slider 26 is located within the binder mechanism 10 between the top spring 12 and the cleats 22. The beam 82 of the slider 26 is located between the prong plates 14 and 16 and the top spring 12. The ramps 28 of the slider 26 extend through the recesses 30 of the prong plates 14 and 16. The flat bottom edge 104 of preferably at least one ramp 28 rests on a smooth first surface 106 of the cleats 22. In another embodiment, the flat bottom edge 104 of the ramps 28 is free-floating and does not come into contact with the cleats 22. The beam 82 includes two elongated orifices 108 and 110 for receiving the rivets 24 of the cleats 22 for completing assembly of the binder mechanism 10. As shown, the orifices 108 and 110 are preferably located towards the ends 84, 86 of the beam 82.

As shown in FIG. 1, the first end 84 of the slider preferably includes a pair of extended secondary tabs 103 located perpendicular to the elongated surfaces 88 and 90 and extending from an end portion of each edge 92 and 94. Preferably, the extended secondary tabs 103 extend directly downward from the first end 84 of the slider 26 and feature a flat bottom edge 105 and an inclined side 107 that meets with the flanges 96 and 98 on the edges 92 and 94 of the slider 26. Preferably, the extended secondary tabs 103 are in parallel relation with each other. The extended secondary tabs 103 assist in pivotally attaching the handle 34.

As shown in FIGS. 1, 5 and 6, the binder mechanism also preferably includes cleats 22. Preferably, the binder mechanism 10 includes at least two cleats 22; however, one cleat 22 could be used. The cleats 22 of the binder mechanism 10 are formed with a base 32. Preferably, the base 32 includes the smooth first surface 106 and a second surface 112 having fasteners 114 that are used to secure the binder mechanism 10 to a binder 111. As shown in FIG. 1, preferably the smooth first surface 106 has an extension 109 toward the center of the binder mechanism 10. Preferably, at least one ramp 28 of the slider 26 rides or rests on the first surface 106 or extension 109 of one cleat 22. This allows the ramp 28 to ride or slide on the first surface 106 or extension 109 when the slider 26 is moved longitudinally and thereby assists in preventing damage to the binder 111. The other ramps 28 may be free-floating. More preferably, the two pairs of ramps 28 located towards the ends 84 and 86 of the slider 26 rest on the first surface 106 or extension 109 of the two cleats 22. Also, the third pair of ramps 28 located between outer two pairs of ramps 28 may additionally rest on the first surface 106 or extension 109 of the closest cleat 22, or on an additional third cleat 22. If not, then the third pair of ramps 28 may float over the spine of the binder 111. Additionally, in another embodiment, the ramps 28 do not contact the cleats 22 and instead are free-floating.

Preferably, the fasteners 114 are prongs or nail bursts that are attachable to the vinyl or other surface of a spine of a binder 111. Any other fasteners known to those skilled in the art could be used such as rivets, pins, or glue. Four fasteners 114 are shown for illustration, but any number of fasteners 114 could be used. The cleats 22 also include a rivet 24 extending from the smooth first surface 106 for assembling the binder mechanism 10. Any other device known to those skilled in the art could be used to assemble the parts of the binder mechanism, including a pin or nail. The rivets 24 extend through the elongated orifices 108 and 110 in the beam 82, and the opening 52 in the top surface 36 of the top spring 12. The rivets 24 are secured to the top surface 36 of the top spring 12.

In another embodiment, the binder mechanism does not have cleats 22. Instead, a rivet 24 is attached to the binder 111 and connects at least the slider 26 and the top spring 12 to the binder. Preferably, the rivet 24 is attached to the binder through the spine of the binder. The rivet may include a step, and thus have two diameters. The step is preferably located between the slider 26 and the top spring 12 and acts as a spacer between these two components. The ramps 28 of the slider 26 may be free-floating in this embodiment.

Finally, as shown in FIGS. 1–4, the handle 34 of the binder mechanism 10 is pivotally attached to an end 42 of the top spring 12. Preferably, the handle 34 is also attached to an end 84 of the slider 26 in such a manner that when the handle 34 is pivoted the slider 26 is moved from a first longitudinal position to a second longitudinal position. The elongated orifices 108 and 110 of the slider 26 accommodate the movement of the slider 26 without disturbing the rivets 24 extending through the orifices 108 and 110. Preferably, as shown, the slider 26 is moved and away from the handle 34.

As shown in FIG. 1, preferably the handle 34 features a back 118 and two side pieces 120 and 122. The side pieces 120 and 122 are located perpendicular to the back 118 such that the back 118 connects the two side pieces 120 and 122 at a connection 124. As shown, preferably, the back 118 extends beyond the connection 124 to a first end 126 of the handle 34, and the two side pieces 120 and 122 extend beyond the back 118 to the opposing second end 128 of the handle 34. The two side pieces 120 and 122 each have an inner and outer surface 130 and 132. First and second pivots 134 are provided on the outer surface 132 of each side piece 120 and 122. Preferably, the first and second pivots 134 are in alignment and are located adjacent to the connection 124 between the back 118 and side pieces 120 and 122. Third and fourth pivots 136 are provided on the inner surface 130 of each side piece 120 and 122. Preferably, the third and fourth pivots 136 are in alignment and are located on the portion of the side pieces 120 and 122 that extend beyond the back 118 of the handle 34. The pivots 134 and 136 are preferably nubs that are insertable into pivots points that allow the nubs to pivot. Preferably, the nubs 134 and 136 are punched into the side pieces 120 and 122. The pivots 134 and 136 could also be a hinge, pin or any other device known to those skilled in the art for pivotally attaching the handle 34.

As shown in FIGS. 1 and 4, tabs 57 of the notch 53 of the top spring 12 each feature pivot points 59 for accommodating the first and second pivots 134 of the handle 34. Further, as shown in FIG. 1, the extended secondary tabs 103 on the slider 26 each feature pivot points 138 for accommodating the third and fourth pivots 136 of the handle 34. Preferably, the pivot points 59 and 138 are holes or slots that allow the pivotal insertion of a nub or pin 134 and 136. However, any pivotal mechanism for attaching the handle 34 known to those skilled in the art could be used. Thus, preferably the nubs 134 and 136 are fit into the holes 59 and slots 138 to pivotally attach the handle 34 to the slider 26 and top spring 12. The handle 34 is pivotally attached to allow the handle 34 to pivot and move the slider 26 from a first longitudinal position into a second longitudinal position.

As the slider 26 is moved from the first longitudinal position to the second longitudinal position, the ramps 28 contact the recess edges 74 causing the prong plates 14 and 16 to move to the first raised position or the second lowered position. Preferably, the flat bottom edge 104 of the ramps slide on the smooth first surface 106 of the cleats 22 as the slider is moved forward. Further, the ramps 28 are preferably located immediately adjacent to the apertures 62 for locating the ring segments 18 and 20 to exhibit positive control over the opening or closing of the ring segments and to minimize warping of the prong plates. Preferably, prong plate movement is restricted by the slider 26 to assist in preventing accidental opening of the ring segments 18 and 20. The over center position of the handle 34 also assists in preventing the accidental opening of the ring segments 18 and 20. As shown in FIG. 5, when the prong plates 14 and 16 are toggled into the first raised position, the ring segments 18 and 20 are separated so that papers may be inserted or removed. Further, as shown in FIG. 6, when the prong plates 14 and 16 are toggled into the second lowered position, the ring segments 18 and 20 mate to form a ring 56 so that the papers are locked within the binding mechanism 10.

The binder mechanism of the present invention could be made with more or fewer ring segments than illustrated. The additional rings can be provided with accommodating apertures, corresponding ramps and their accommodating recesses to allow the ring segments to be opened and closed without warping the prong plates as described in the specification.

Preferably, the binder mechanism 10 is manufactured using current manufacturing techniques for binder assemblies. The binder mechanism can be made of metal or plastics. Preferably, the binder mechanism 10 is made of metal and at least some of the parts are produced through a stamping process. The handle 34 may be formed as a molded plastic assembly.

One of ordinary skill in the art can envision numerous variations and modifications to the invention disclosed herein. For example, the handle of the binder mechanism could be made of several pieces that are affixed to each other and attached to the top spring and the slider such that when the handle is moved the slider is moved and causes the prong plates to toggle toward or away from the top spring. All of these modifications are contemplated by the true spirit and scope of the following claims.

What is claimed is:

1. A binder mechanism comprising:

a retainer;

a pair of prong plates having outside edges and retained in parallel relation to one another against inner edges by the retainer such that the prong plates are capable of toggling between a raised position and a lowered position;

a plurality of ring segments attached to the prong plates at attachment positions forming loops when in a closed position;

a movable cam mechanism having cam members adjacent the attachment positions; and a handle pivotable with respect to the retainer and the cam mechanism for moving the cam mechanism to cause the cam members to toggle the prong plates between the raised position and the lowered position.

2. The binder mechanism of claim 1 wherein:

the cam mechanism is a slider having two ends and at least one pair of ramps extending from the slider; and the prong plates defining at least one recess having recess edges along the inner edges of the prong plates;

wherein the pair of ramps extend through the recess in the prong plates such that when the slider is moved the ramps abut the recess edges and cause the prong plates to toggle to the raised position and the lowered position.

3. The binder mechanism of claim 1, wherein:

the ring segments form loops when the prong plates are toggled to the lowered position.

4. The binder mechanism of claim 1, wherein:

the retainer comprises a top spring having at least two flanges connected by a top surface, with the outside edges of the prong plates being captured between the top surface and the flanges thereby locating the prong plates in a side-by-side relation such that they are capable of toggling between the raised position and the lowered position.

5. The binder mechanism of claim 2 further comprising:

at least three pairs of ramps; and a center of the slider;

wherein two pairs of ramps are located towards the ends of the slider and the third pair is located between them and offset from the center of the slider.

6. The binder mechanism of claim 4 wherein:

the cam mechanism is a slider having a beam and at least one pair of ramps aligned in parallel relation extending from the slider; and an inner edge on each prong plate where the prong plates meet each other in parallel relation, the prong plates defining at least one recess having recess edges along the inner edges of the prong plates;

wherein the pair of ramps extend through the recess in the prong plates such that the beam is located between the top spring and the prong plates, and the ramps extend beyond the prong plates;

wherein when the slider is moved the ramps abut the recess edges and cause the prong plates to toggle to the raised position and the lowered position.

7. The binder mechanism of claim 6 wherein:

an attachment mechanism is provided connecting the slider to the top spring; and wherein the attachment mechanism is capable of attaching the binder mechanism to a binder assembly.

8. A binder mechanism comprising:

a top spring;

a pair of prong plates having outside edges and retained in parallel relation to one another against inner edges by the retainer spring such that the prong plates are capable of toggling between a raised position and a lowered position;

an inner edge on each prong plate where the prong plates meet each other in parallel relation, the prong plates defining at least one recess having recess edges along the inner edges of the prong plates;

a plurality of ring segments attached to the prong plates at attachment positions forming loops when in a closed position;

a movable cam mechanism having cam members adjacent the attachment positions, the cam mechanism is a slider having a beam and at least one pair of ramps extending from the slider; and a handle pivotally attached to the top spring and the slider;

wherein the pair of ramps extend through the recess in the prong plates such that the beam is located between the top spring and the prong plates, and the ramps extend beyond the prong plates;

wherein the top spring having at least two flanges connected by a top surface, with the outside edges of the prong plates being captured between the top surface and the flanges thereby locating the prong plates in a side-by-side relation such that they are capable of toggling between the raised position and the lowered position and when the slider is moved the ramps abut the recess edges and cause the prong plates to toggle to the raised position and the lowered position; and wherein the handle is capable of pivoting and thereby moving the slider.

9. The binder mechanism of claim 8, wherein:

the attachment positions are apertures in the prong plates for attaching the ring segments to the prong plates.

10. The binder mechanism of claim 9, wherein:

pairs of apertures attach the ring segments to the prong plates;

wherein each recess is located adjacent a pair of apertures.

11. The binder mechanism of claim 10, wherein:

the recesses have a longitudinal length; and the recesses are located at a distance of no more than the length of the recess from the pair of apertures.

12. The binder mechanism of claim 11 wherein:

the recesses are located at a distance of no more than one-half the length of the recess from the pair of apertures.

13. A binder mechanism comprising:

a binding assembly, comprising, a retainer;

a pair of prong plates having outside edges and retained in parallel relation to one another against inner edges by the retainer spring [such that the prong plates are capable of toggling between a raised position and a lowered position,] the prong plates together defining at least one recess having recess edges along the inner edges of the prong plates;

a plurality of ring segments attached to the prong plates at attachment positions forming loops when in a closed position;

a slider having two ends and at least one ramp extending from the slider; and at least two cleats, each cleat having a base of separate construction from the other base and a post attaching the binding assembly to the base;

wherein the ramp extends through the recess in the prong plates to the corresponding base of the cleat such that the slider is capable of moving and the ramps riding on the corresponding base of the cleat.

14. The binder mechanism of claim 13, further comprising:

at least three pairs of ramps; and a center of the slider;

wherein two pairs of ramps are located towards the ends of the slider and the third pair is located between them and offset from the center of the slider.

15. The binder mechanism of claim 13, wherein:

the retainer spring is a top spring having at least two flanges connected by a top surface, with the outside edges of the prong plates being captured between the top surface and the flanges thereby locating the prong plates in a side-by-side relation such that they are capable of toggling between the raised position and the lowered position.

16. A binder mechanism of claim 13 further comprising:

at least two spaced apart cleats, each cleat having its own corresponding base configured for slidably accommodating the ramp.

17. The binder mechanism of claim 14, wherein:

the two pairs of ramps located towards the ends of the slider each rest on the base of a cleat.

18. The binder mechanism of claim 14, wherein:

two pairs of ramps rest on the same base of the cleat.

19. The binder mechanism of claim 13, wherein the base of the cleat comprises an extension disposed such that the ramps ride on the extension.

20. The binder mechanism of claim 15, wherein:

the rivet attaches the top spring and the slider to the cleat.

21. A binder mechanism comprising:

a top spring;

a pair of prong plates held in parallel relation with each other against inner edges by the top spring, the prong plates being capable of toggling between a raised position and a lowered position, the prong plates together defining at least one recess along the inner edges of the prong plates;

a plurality of ring segments attached to the prong plates at attachment points, the ring segments forming loops when in a closed position;

a slider movable between a first and a second position, the slider having at least one pair of ramps extending through the recess formed by the prong plates; and at least one cleat having a base and a rivet, the rivet attaching the top spring and the slider to the cleat;

a handle pivotally attached to the top spring and the slider;

wherein the pair of ramps are located adjacent to where the ring segments are attached to the prong plates;

wherein the pair of ramps is supported against the base of the cleat;

wherein the slider is capable of being moved by pivoting the handle causing the ramps to contact the prong plates and thereby causing the prong plates to toggle between the raised position and the lowered position.

22. The binder mechanism of claim 21 wherein:

the recess further includes recess edges such that when the slider is moved from the first position to the second position the ramps contact the recess edges and causes the prong plates to toggle for opening or closing the ring segments.

23. A binder mechanism comprising:

a retainer;

a pair of prong plates having outside edges and retained in parallel relation to one another against inner edges by the retainer spring such that the prong plates are capable of toggling between a raised position and a lowered position;

a plurality of ring segments attached to the prong plates at attachment positions forming loops when in a closed position;

a movable cam mechanism having cam members adjacent the attachment positions; and a handle pivotally attached to the retainer spring and the slider;

wherein the cam mechanism is capable of being moved by pivoting the handle causing the cam members to toggle the prong plates between the raised position and the lowered position.

24. A binder mechanism comprising:

a binding assembly configured for binding a stack and having a slider with at least one ramp; and first and second cleats, each comprising, a base having a length;

an extending portion extending outwardly from the base along its length;

a first surface and a second surface on opposite sides of the base and extending portion, the second surface being configured for securing to a folder; and a post extending upwardly from the first surface on the base and configured for attaching to a binding assembly;

wherein the first surface is configured for slidably accommodating the ramp of the slider of a binder mechanism for riding on the first surface, and the extending portion is less than three times the length of the base.

25. A binder mechanism comprising:

a retainer;

a pair of prong plates having outside edges and retained in parallel relation to one another against inner edges by the retainer spring such that the prong plates are capable of toggling between a raised position and a lowered position, the prong plates together defining at least one recess having recess edges;

a plurality of ring segments attached to the prong plates at attachment positions forming loops when in a closed position;

a movable cam mechanism having cam members substantially adjacent the attachment positions; and a handle pivotable with respect to the retainer and the cam mechanism for moving the cam mechanism to cause the cam members to contact the recess edges of the recess to toggle the prong plates between the raised position and the lowered position.

26. The binder mechanism of claim 25, further comprising:

a recess end;

a first length for the distance between the attachment position and the recess end of the closest recess; and a second length between ring segments;

wherein the first length is no more than one-third the second length.

27. The binder mechanism of claim 25, further comprising:

two recess ends;

a first length for the distance between the attachment position and the most distant recess end of the closest recess; and a second length between ring segments;

wherein the first length is no more than one-third the second length.

28. The binder mechanism of claim 26, wherein:

the cam members are immediately adjacent the attachment positions.

* * * * *

UNITED STATES PATENT AND TRADEMARK OFFICE

CERTIFICATE OF CORRECTION

PATENT NO. : 6,276,862 B1
DATED : August 21, 2001
INVENTOR(S) : Michael Thom Synder; Timothy Edward McKeown; R. Hal Monson; and David Little It is certified that error appears in the above-identified patent and that said Letters Patent is hereby corrected as shown below:

Column 10,
Line 44, delete "[such that the prong plates are capable of toggling between a raised position and a lowered position,]".

Signed and Sealed this

Twenty-sixth Day of March, 2002

*Attest:*

*Attesting Officer*

JAMES E. ROGAN
*Director of the United States Patent and Trademark Office*